US010424165B2

(12) United States Patent
Hosokawa

(10) Patent No.: US 10,424,165 B2
(45) Date of Patent: Sep. 24, 2019

(54) GAME SYSTEM, AND CONTROL METHOD AND COMPUTER READABLE STORAGE MEDIUM USED THEREFOR

(71) Applicant: Konami Digital Entertainment Co., Ltd., Minato-ku, Tokyo (JP)

(72) Inventor: Takayuki Hosokawa, Minato-ku (JP)

(73) Assignee: KONAMI DIGITAL ENTERTAINMENT CO., LTD., Tokyo (JP)

( * ) Notice: Subject to any disclaimer, the term of this patent is extended or adjusted under 35 U.S.C. 154(b) by 267 days.

(21) Appl. No.: 15/472,087

(22) Filed: Mar. 28, 2017

(65) Prior Publication Data

US 2017/0200344 A1 Jul. 13, 2017

Related U.S. Application Data

(63) Continuation of application No. PCT/JP2015/080919, filed on Nov. 2, 2015.

(30) Foreign Application Priority Data

Nov. 5, 2014 (JP) ..... 2014-225183

(51) Int. Cl.
*G07F 17/34* (2006.01)
*G07F 17/32* (2006.01)
(Continued)

(52) U.S. Cl.
CPC ..... *G07F 17/329* (2013.01); *A63F 3/06* (2013.01); *A63F 5/02* (2013.01); *G07F 17/3216* (2013.01); *G07F 17/3258* (2013.01); *G07F 17/34* (2013.01)

(58) Field of Classification Search
USPC ..... 463/19
See application file for complete search history.

(56) References Cited

U.S. PATENT DOCUMENTS 8,251,807 B2 * 8/2012 LeMay ..... A63F 13/12 463/29
2008/0096656 A1 * 4/2008 LeMay ..... A63F 13/12 463/31
2008/0108417 A1 * 5/2008 Sakuma ..... G07F 17/32 463/20

FOREIGN PATENT DOCUMENTS

JP 2006-068131 A 3/2006
JP 2008119060 A 5/2008
(Continued)

OTHER PUBLICATIONS

Decision to Grant a Patent (JP Patent Application No. 2014-225183); Date of Drafting: Dec. 19, 2018; 6 pages.
(Continued)

*Primary Examiner* — Pierre E Elisca
(74) *Attorney, Agent, or Firm* — Howard & Howard Attorneys PLLC

(57) ABSTRACT

A game system includes a lottery mechanism that selects some numbers out of a plurality of numbers, and controls values in each of a plurality of cells M11 through M44 displayed upon a game screen in a plurality of stages, on the basis of selections by the lottery mechanism, wherein: correlation between the selections by the lottery mechanism and the control of the values of the cells M are set so as to be mutually different between at least two of the stages; the values of the cells are controlled for each stage on the basis of the selection by the lottery mechanism and the correlation of the stage; and when change to a different stage is performed, the values of the cells after the change are set on the basis of the value of the cells before the change.

11 Claims, 12 Drawing Sheets

(51) Int. Cl.
*A63F 3/06* (2006.01)
*A63F 5/02* (2006.01)

(56) References Cited

FOREIGN PATENT DOCUMENTS

| | | | |
|---|---|---|---|
| JP | 2011067534 | A | 4/2011 |
| WO | 2013146072 | A1 | 10/2013 |

OTHER PUBLICATIONS

English Translation of Japanese Office Action (Notification of Reasons for Refusal); Japanese Patent Application No. 2014-225183; Date of Drafting Oct. 20, 2017; 7 pages.
ISA/210 PCT International Search Report (PCT/JP2015/080919), dated Jan. 26, 2016, 5 pages.
ISA/237 PCT Written Opinion of the International Search Authority (PCT/JP2015/080919), dated Jan. 26, 2016, 12 pages.
Notification of Reasons for Refusal (JP Patent Application No. 2014-225183); dated May 16, 2018; Includes English Translation.

* cited by examiner

GAME SYSTEM, AND CONTROL METHOD AND COMPUTER READABLE STORAGE MEDIUM USED THEREFOR

CROSS-REFERENCE TO RELATED APPLICATION

This application is a continuation of PCT Application No. PCT/JP2015/080919, filed Nov. 2, 2015, which claims priority to Japanese Patent Application No. 2014-225183, filed Nov. 5, 2014, the disclosures of which are hereby incorporated by reference in their entirety.

TECHNICAL FIELD

The present invention relates to a game system and the like that includes an element selection device that selects some selective elements from a plurality of selective elements, and a value control device that controls the value of a game element displayed in a game image on the basis of that selection.

BACKGROUND ART

As a game system that controls the progression of a game according to elements that are selected from a plurality of selective elements, a bingo game machine is per se known (for example, Patent Literature #1) that establishes correspondence between a plurality of numbers that are the subjects to be selected by a lottery device which serves as an element selection device, and a plurality of numbers that are respectively allocated to each of a plurality of cells which serve as game elements, that makes the cells corresponding to the numbers which are selected activate in series, and that gives a reward to a user when the activated cells form some particular fixed arrangement.

CITATION LIST

Patent Literature

Patent Document #1: Japanese Laid-Open Patent Publication 2011-67534.

SUMMARY OF INVENTION

Technical Problem

In the game machine described above, correspondence is established on a one-to-one basis between the selective elements that are selected and the game elements, and the value of each game element is evaluated only from one type standpoint i.e. either activated or inactivated. Accordingly, there is a danger that the development of the game will become monotonous.

Accordingly, it is the object of the present invention to provide a game system and the like, that is capable of changing the value of a game element on the basis of selection of a selective element, in many different ways.

Solution to Technical Problem

One aspect of the present invention provides a game system comprising an element selection device which is configured to select some selective elements from among the plurality of selective elements, and a computer programmed to function as a value control device which is configured to control, in a plurality of stages based on selection by the element selection device, a value for each game element which is displayed in a game image, wherein: the value control device is configured to set correlations between selection by the element selection device and control of the value of each game element so as to be mutually different between at least two of the plurality of stages; and, while controlling the value of each game element in each of the plurality of stages based on the selection by the element selection device and the correlation for each of the plurality of stages, when a change to a different stage is made, set the value of each game element after the change based on the value of the game element before the change.

Another aspect of the present invention provides a method for controlling a game system comprising a computer, the computer controlling a value for each game element displayed in a game image, in a plurality of stages based on selection of some selective elements from among a plurality of selective elements by a predetermined element selection device, comprising the steps of: setting correlations between selection by the element selection device and control of the value of each game element so as to be mutually different between at least two of the plurality of stages; controlling the value of each game element in each of the plurality of stages based on the selection by the element selection device and the correlation for each of the plurality of stages; and when a change to a different stage is made, setting the value of each game element after the change based on the value of the game element before the change.

A further aspect of the present invention includes a non-transitory computer readable storage medium storing a computer program for a game system comprising a computer, the computer controlling a value for each game element displayed in a game image, in a plurality of stags based on selection of some selective elements from among a plurality of selective elements by a predetermined element selection device, the computer program making the computer execute the steps of: controlling the value of each game element in each of the plurality of stages based on the selection by the element selection device and the correlation for each of the plurality of stages; and when a change to a different stage is made, setting the value of each game element after the change based on the value of the game element before the change.

DESCRIPTION OF EMBODIMENTS

Figure 1:
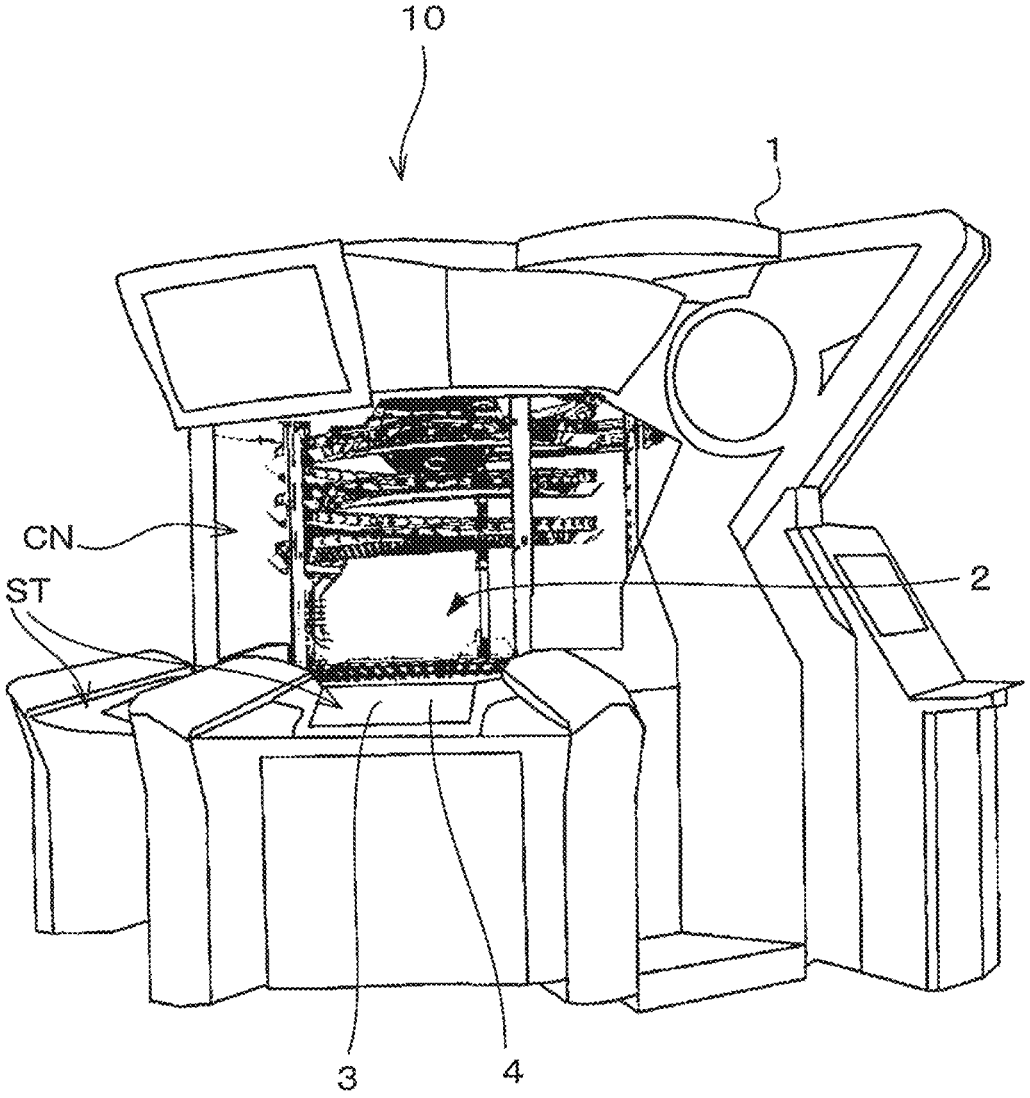
FIG. 1 is an overall view showing a game machine to which a game system according to an embodiment of the present invention is applied.

FIG. 1 is an overall view showing a game machine 1 to which a game system 10 according to an embodiment of the present invention is applied. This game machine 1 is built as a game machine for commercial use (i.e. for business use) that, in exchange for payment of a predetermined playing fee, allows a user to play a game over a range that corresponds to that playing fee. This type of game machine 1 is sometimes termed an arcade game machine. The game machine 1 is installed in a predetermined facility such as a store or the like, with the primary objective of causing a large number of users to play the game repeatedly, thus making a profit.

Figure 2:
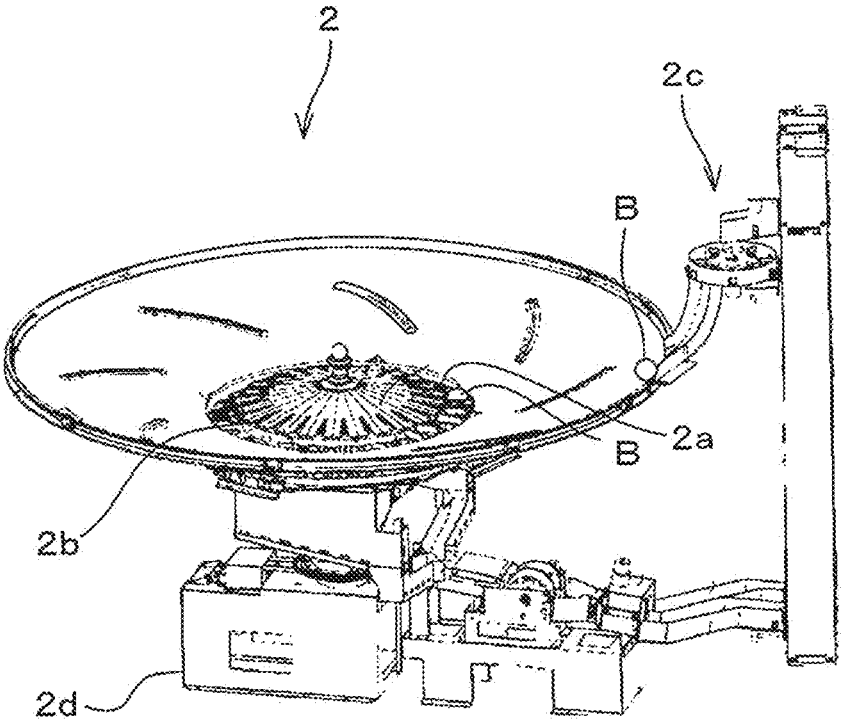
FIG. 2 is a partial enlarged view of main portions of a lottery mechanism.

The game machine 1 comprises a center unit CN and a plurality of station units ST that are arranged to surround this center unit CN. In the center unit CN, a lottery mechanism 2 is provided for selecting any number from a plurality of numbers (as one example, from integers from 1 to 25), so that these selected numbers may serve as a plurality of selective elements. FIG. 2 is an enlarged view of main portions of the lottery mechanism 2. In this lottery mechanism 2, there are provided a rotatable roulette wheel 2*b* that has a plurality of pockets 2*a* one corresponding to each of the plurality of numbers, a ball launching mechanism 2*c* that launches a ball B onto the roulette wheel 2*b*, and a ball collecting mechanism 2*d* that collects the ball B from one of the pockets 2*a*. A ball B is launched from the ball launching mechanism 2*c* onto the roulette wheel 2*b* which is rotating, and this ball B falls into one of the pockets 2*a*. After the game ends, the ball collecting mechanism 2*d* retrieves the ball B from the pocket 2*a*, and supplies it back to the ball launching mechanism 2*c*. This lottery mechanism 2 is a per se known physical lottery mechanism by which the number that corresponds to the pocket 2*a* into which the ball B falls is selected as a result of the lottery, and may be constructed by using per se known technology. Moreover, this lottery mechanism 2 may be realized in various ways other than by means of a roulette system, such as a rotatory lottery machine, an electronic lottery mechanism that employs random numbers, or the like.

A cultivation game that progresses on the basis of the numbers selected by the lottery mechanism 2 can be played upon each of the station units ST. Each of the station units ST is provided with a medal intake slot (not shown in the figures), a display device 3, and a transparent touch panel 4 that is overlaid over the display device 3. The user plays the cultivation game by actuating the touch panel 4 according to the game screen that is displayed upon the display device 3.

Figure 3:
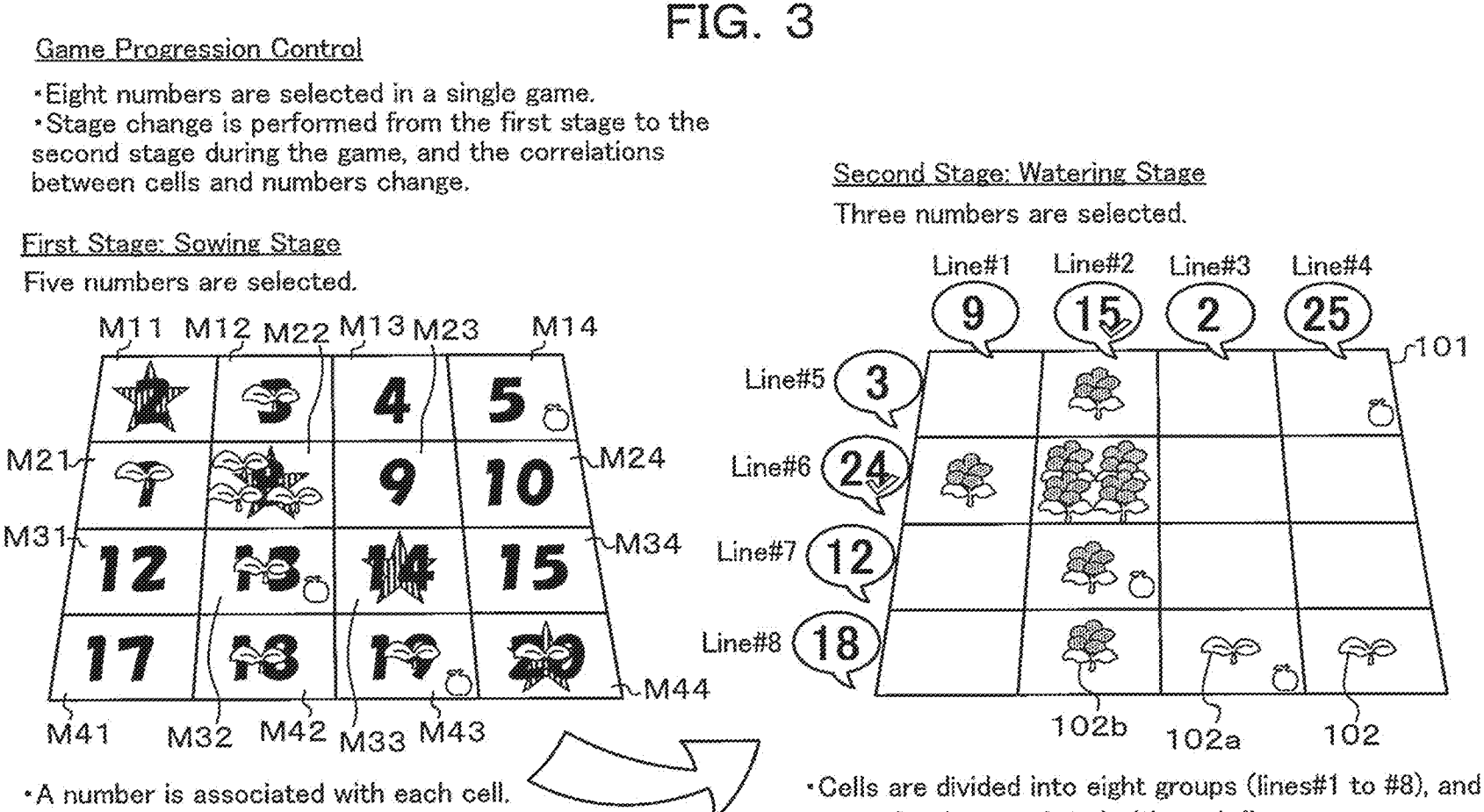
FIG. 3 is a conceptual diagram for explanation of game progression control of a cultivation game.

FIG. 3 is a conceptual diagram for explanation of game progression control of the cultivation game. The cultivation game is a game in which plants 102 that have been planted in a flower bed 101 displayed upon a display device 3 are cultivated according to numbers selected by the lottery mechanism 2. The flower bed 101 is defined as a total of sixteen cells M11, M12, . . . M43, M44 that are arranged in four rows by four columns (in some cases one of these cells may simply be referred to by the reference symbol M when no specific one of them is intended to be designated), and the state of the plant 102 (corresponding to value of a game element) that is planted in each of the cells M11 through M44 changes according to the results of selection by the lottery mechanism 2. Within a single cultivation game, eight numbers are selected by the lottery mechanism 2 from among the numbers 1 through 25. As one example, three numbers may be selected in a first lottery, two numbers may be selected in a second lottery, and one number may be selected in each of third through fifth lotteries. With regard to the method of lottery, it would be acceptable to arrange for all the required numbers to be selected in a single lottery, or alternatively for one number to be selected in each lottery, any appropriate method may be employed for selecting the numbers.

This cultivation game includes a first stage in which seeds are planted in the flower bed 101, and a second stage in which flowers are made to bloom by applying water to sprouts 102*a* that have sprung from the seeds. In the first stage, one number is associated with each cell M, and, when a number associated with a cell M is selected by the lottery mechanism 2, a seed is sown in that cell M, and a sprout 102*a* appears. It should be understood that, in a case that the number associated with a cell M is selected by the lottery mechanism 2, then this is sometimes termed a "hit". The number of seeds in each cell M can be identified by the number of sprouts 102*a*. A maximum of four seeds can be sown in a single cell M. In principle, seeds are sown in the flower bed 101 according to the results of selection by the lottery mechanism 2.

The cultivation game progresses in the first stage while five numbers are selected by the lottery mechanism 2, and changes over to the second stage when five numbers have been selected. When the stage of the game changes from the first stage to the second stage, the correlations between the cells M and the numbers selected by the lottery mechanism 2 change. In the second stage, with respect to the cells M11 through M44, the cells M aligning on the same row or on the same column (for example the cells M11 through M14) form a single group. Due to this, eight groups are defined upon the flower bed 101. In some cases herein, these eight groups will be distinguished by calling them "line #1" through "line #8" respectively. A number is associated with each of these lines, and these numbers now become subjects of lottery by the lottery mechanism 2. A random number selected from among the numbers that have not yet been selected is associated with each line. When an associated number is selected by the lottery mechanism 2, in a case that there is a cell M in which a seed was sown (i.e. a cell M where a sprout 102*a* is sprouting) among the cells M belonging to the line corresponding to that number, then that sprout 102*a* is changed into a flower 102*b*; and in a case that a flower 102*b* already changed exists in the cell M, then the number of flowers 102*b* (i.e. the number of seeds in cell information) is increased by one. It should be understood that, when the number associated with a line is selected by the lottery mechanism 2, sometimes this is termed a "hit". When the cultivation game ends, a reward is given to the user according to the number of flowers 102*b* that are blooming in the flower bed 101.

When the stage changes from the first stage to the second stage, the number of seeds that has been sown in each of the cells M in the first stage is preserved in the second stage. Since the correlations between the cells M and the numbers that are subjects of selection by the lottery mechanism 2 are set to be different between the stages, accordingly it is possible simply and easily to adjust the number of seeds in each cell M and their states. Accordingly, it is possible to change the values in the cells M in many different ways. In the following explanation, in some cases, the first stage will be referred to as the "sowing stage", and the second stage will be referred to as the "watering stage".

FIGS. 4A through 4D are figures showing examples of game screens of this cultivation game. It should be understood that, although the game screens 100A through 100D shown in FIGS. 4A through 4D are shown as examples of game screens, in some cases one of them may simply be referred to as a game screen 100 when no specific one thereof is intended to be designated. On the game screen 100A of FIG. 4A, there are provided the flower bed 101 described above, a lucky number display section 103, a dividend display section 104 that displays dividend to the user, a lottery state display section 105 that displays the state of lottery by the lottery mechanism 2, a credit display section 106 that displays the credit balance of the user such as the number of credits possessed by the user, the number of his bets in the game currently being played, the number of credits he/she has won, and so on, and a step display section 107 that displays the remaining steps until a jackpot game is performed.

The user bets some of his/her credits as a condition for participation in the cultivation game. For example, he/she may be permitted to participate in the cultivation game in exchange for expenditure of a predetermined amount of credit. Further, he/she may expend some amount of credits in order to progress advantageously in the cultivation game. For example, it would be acceptable to arrange to permit the user to sow a seed (i.e. a sprout 102*a*) in a cell M designated by the user in exchange for expenditure of a predetermined amount of credits. Alternatively, it would be acceptable to arrange to provide this type of advantageous situation without any credit being consumed. Moreover, in some cases, an apple 107*a* may be set in each cell M and may become a subject of counting by the step display section 107. The numbers of the cells M in which these apples 107*a* are set and the number of apples 107*a* that are set may be determined at random. Alternatively, it would also be acceptable to arrange to award the apple 107*a* to one or more cells M in exchange for expenditure of the credits. When a flower 102*b* in the cell M to which the apple 107*a* has been awarded blooms, the apple 107*a* can be acquired, and the step shown in the step display section 107 advances by one. When the final step is reached, a jackpot game is performed by the center unit CN.

Figure 4A:
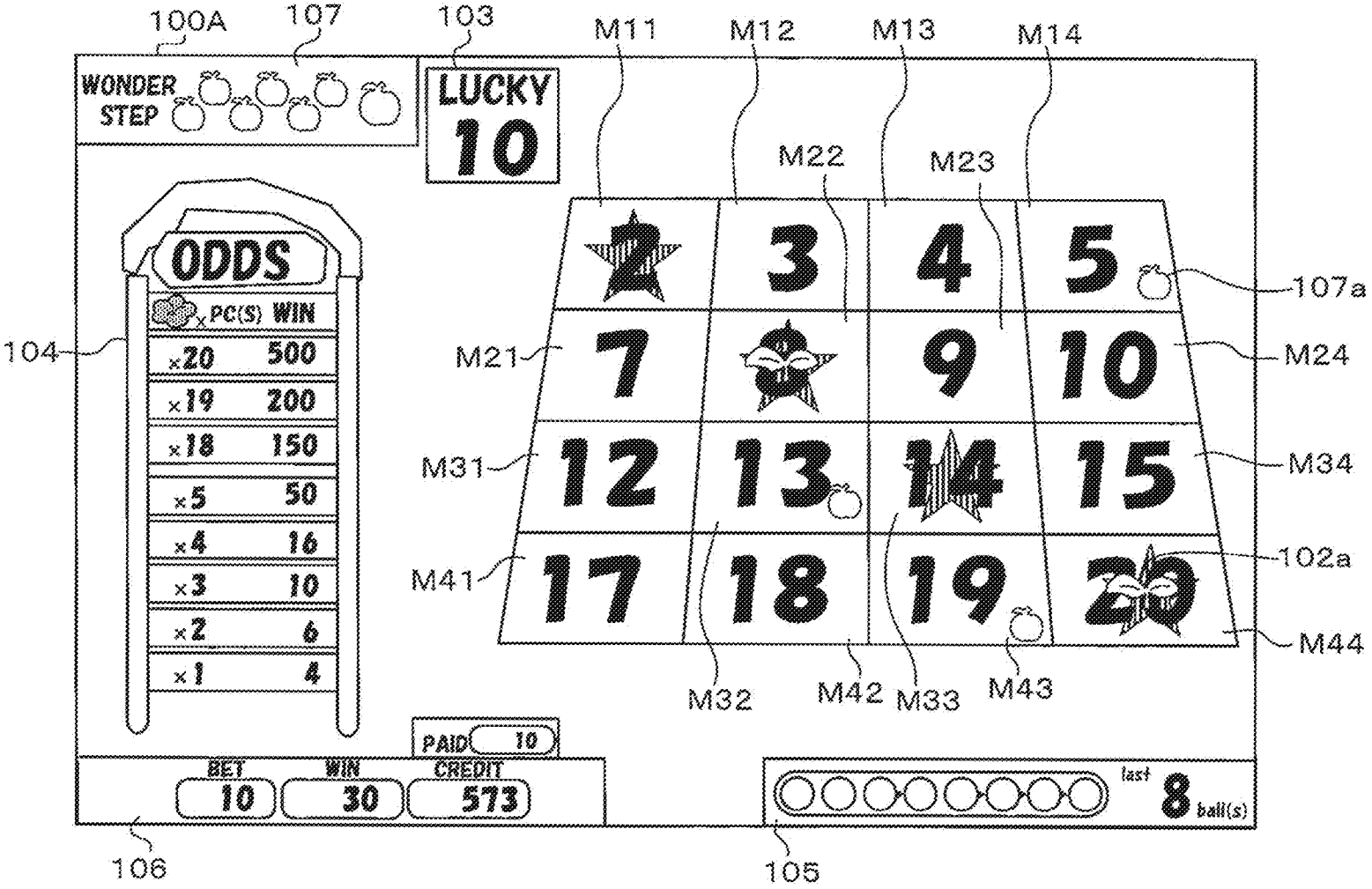
FIG. 4A is a diagram showing an example of a game screen of this cultivation game.

FIG. 4A shows the situation before the cultivation game is started. On the flower bed 101, there are provided cells M22 and M44 on each of which a seed are sown and a sprout 102*a* appears, cells M14, M32, and M43 on each of which an apple 107*a* is set, and cells M11, M22, M33, and M44 each of which is set to a cell M having a lucky number within the flower bed 101 (these are distinguished in FIG. 4A by star signs being displayed in each of the cells M11, M22, M33, and M44). In a case that the number of a cell M which is set to the lucky number is selected, then the number of seeds in each of the cells M that belong to the vertical line including the cell M corresponding to the lucky number is increased by one. Moreover, in a case that the number that is displayed in the lucky number display section 103 is selected, then the numbers of seeds in all of the cells M are increased by one.

Figure 4B:
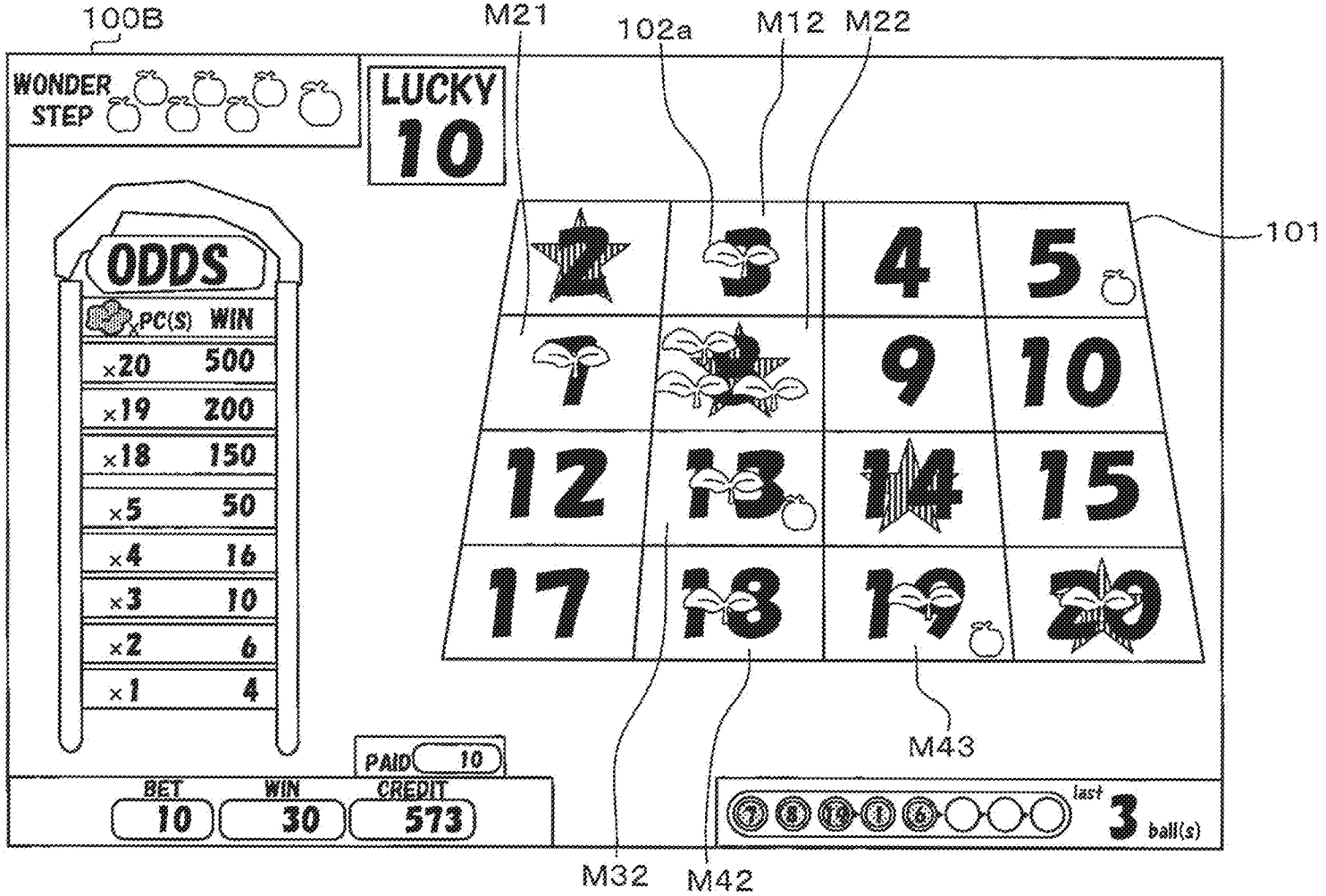
FIG. 4B is a diagram showing an example of a game screen, which is a continuation from the screen of FIG. 4A.

FIG. 4B shows, as a continuation of the game screen 100A of FIG. 4A, a game screen 100B after the cultivation game has been started and five numbers have been selected. As a result of the sowing stage having been started and the numbers "7", "8", "19", "1", and "6" having been selected by the lottery mechanism 2, one seed is added to each of the cells M21, M22, and M43 that have been hit. Furthermore, since the number in the cell M22 which was set as the lucky number has been selected, accordingly the number of seeds in each of the cells M12, M22, M32, and M42 which belong to the vertical line through that cell M22 is increased by one. In each cell M in which the number of seeds has been increased, new sprouts 102*a* according to the number of seeds will appear. It should be understood that, since the numbers "1" and "6" are not associated with any cells M, accordingly they will not exert any influence on the progression of the game even if they happen to be selected by the lottery mechanism 2.

Figure 4C:
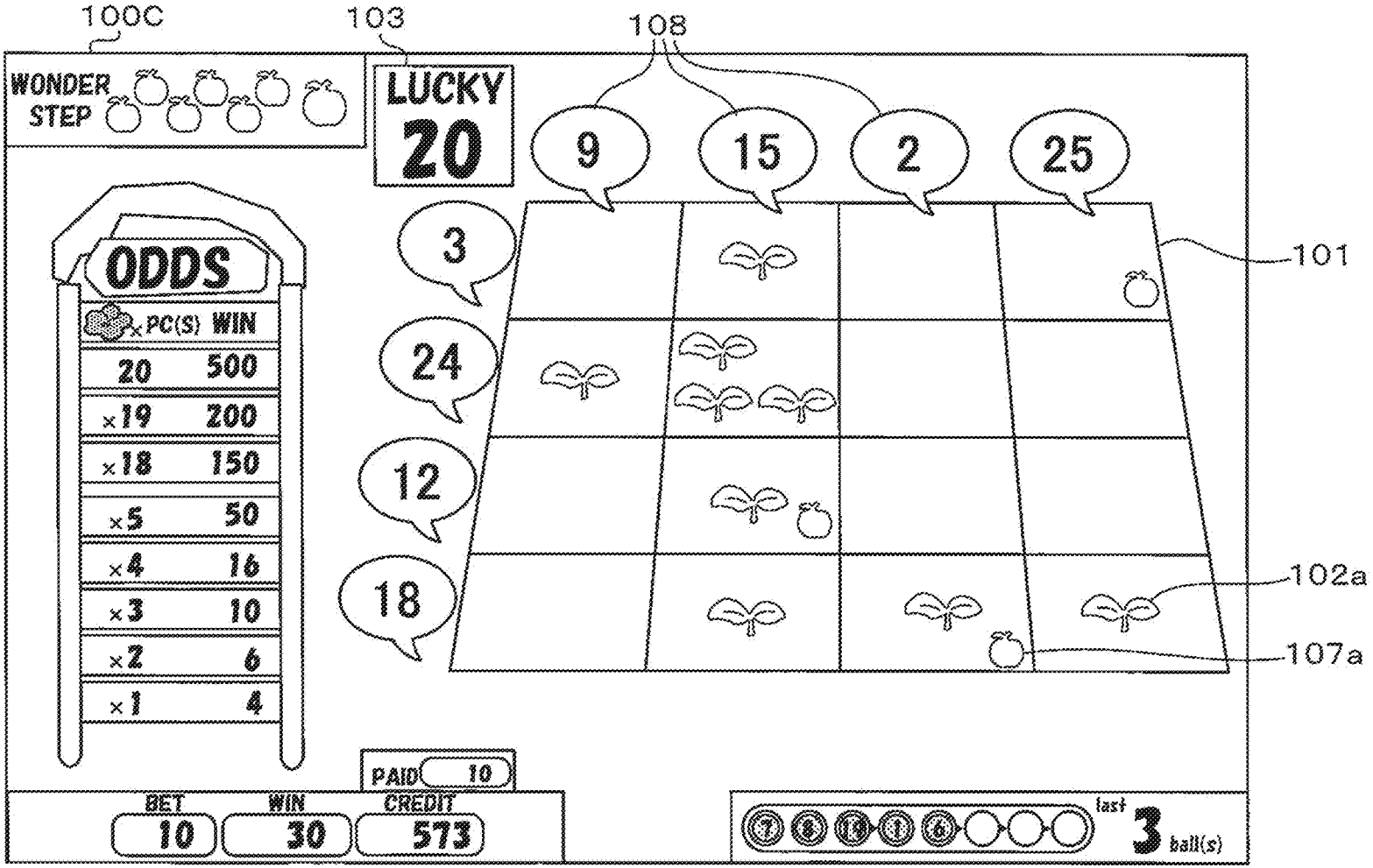
FIG. 4C is a diagram showing an example of a game screen, which is a continuation from the screen of FIG. 4B.

FIG. 4C shows, as a continuation of the game screen 100B of FIG. 4B, a game screen 100C after change from the sowing stage to the watering stage. When the change to the watering stage is made, the correlations between the cells M and the numbers that are subjects of selection by the lottery mechanism 2 change. Along therewith, the number displayed upon each of the cells M disappears, and instead of that, a number is displayed in each number display section 108 corresponding to each vertical line. Moreover, the number displayed in the lucky number display section 103 changes. The numbers that are newly displayed in this watering stage are determined at random from the numbers that have not yet been selected by the lottery mechanism 2. In this watering stage, the game progresses by taking as subjects the cells M in which at least one seed was sown at the sowing stage. Data specifying the number of seeds in each cell M is inherited when the stage advances from the sowing stage to the watering stage.

Figure 4D:
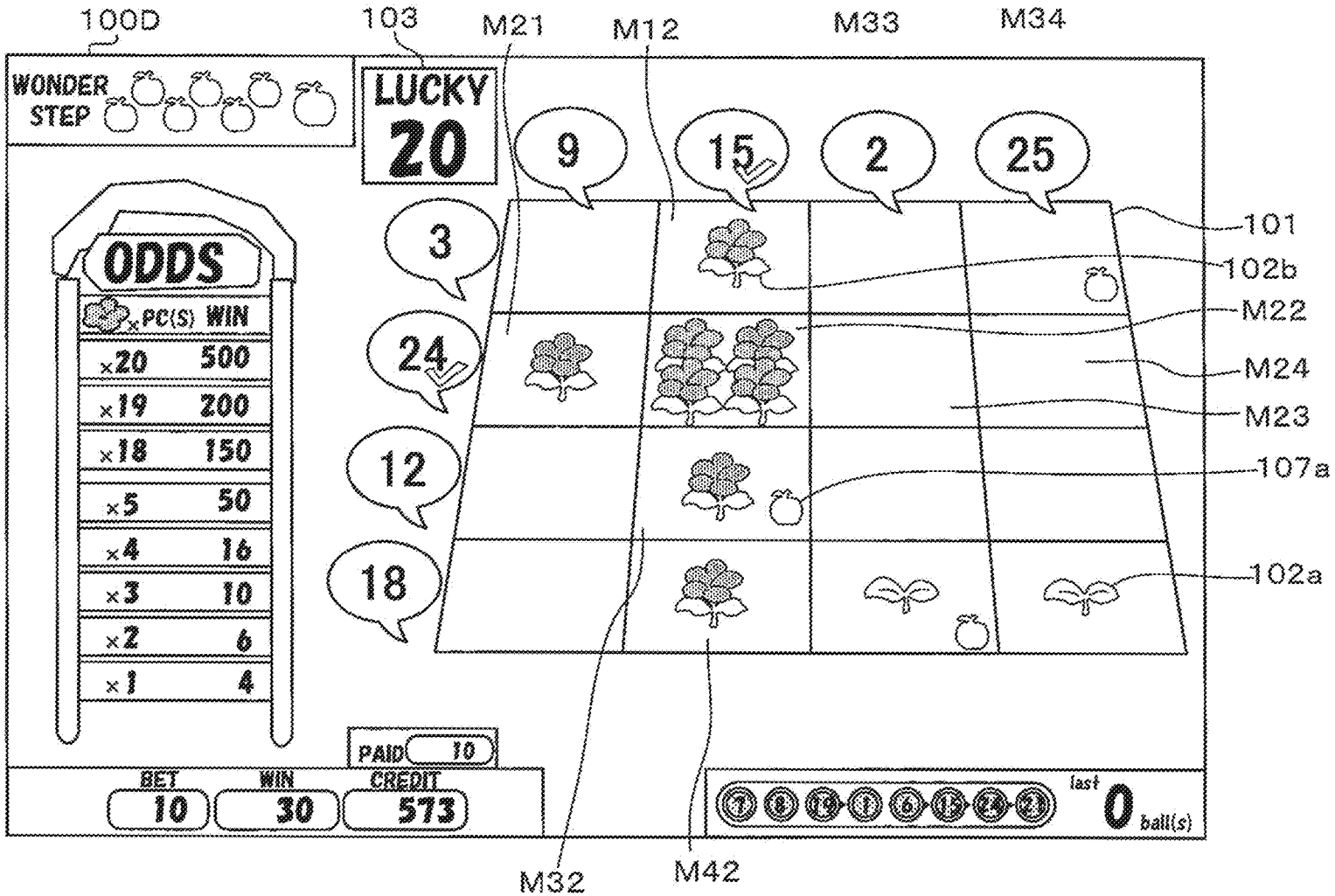
FIG. 4D is a diagram showing an example of a game screen, which is a continuation from the screen of FIG. 4C.

FIG. 4D shows, as a continuation of the game screen 100C of FIG. 4C, a game screen 100D after the watering stage has been started and three numbers have been selected. As a result of the number "15" associated with line #2 having been selected by the lottery mechanism 2, line #2 has become activated, and water has been sprinkled onto each cell in this line #2. The sprouts 102*a* that were growing in the cells M12, M22, M32, and M42 that belong to this line #2 change into flowers 102*b*. Each of the cells M in which the sprouts 102*a* change into flowers 102*b* by the corresponding line activated is a cell M having one or more seeds in its cell information. Next, as a result of the number "24" associated with line #6 having been selected by the lottery mechanism 2, line #6 becomes activated. And, among the cells M21, M22, M23, and M24 that belong to line #6, the cells M12 and M22 have one or more seeds in them. Thus, the sprout 102*a* growing in the cell M12 changes into a flower 102*b*. Moreover, since the cell M22 has already been hit due to the line #2 having been made activated, accordingly the number of flowers 102*b* in that cell M (i.e. the number of seeds in its cell information) is increased by one. It should be understood that since, in the cell information, a maximum of four seeds can be held for each cell M, accordingly the fifth and subsequent seeds are not counted. Therefore, even if the cell M22 is hit again subsequently in this game (for example, a case that the number that is displayed in the lucky number display section 103 is selected), the number of flowers 102*b* therein (i.e. the number of seeds in its cell information) is not increased, and no change to the display is made. Finally, the number "21" that is not associated with any line is selected by the lottery mechanism 2. Since this selected number does not caused to make a hit, this selection has no influence on the progression of the game. And then, the game terminates. It should be understood that in a case that, in the watering stage, the number that is being displayed in the lucky number display section 103 is selected by the lottery mechanism 2, then, with respect to within all of the cells M11 through M44, the cells M that have at least one seed, each sprout 102*a* is changed into a flower 102*b*, and, in a case that such a change into flowers 102*b* has already been performed, then the number of flowers 102*b* (i.e. the number of seeds in the cell information) is increased by one.

When the watering stage ends, a reward is given to the user according to the number of flowers 102*b* that are blooming in the flower bed 101. Since, in FIG. 4D, twelve flowers 102*b* are blooming, accordingly the reward according to this number is given. Furthermore, since a flower 102*b* is blooming in the cell M32 which an apple 107*a* has been associated with, accordingly this apple 107*a* is given to the user.

Figure 5:
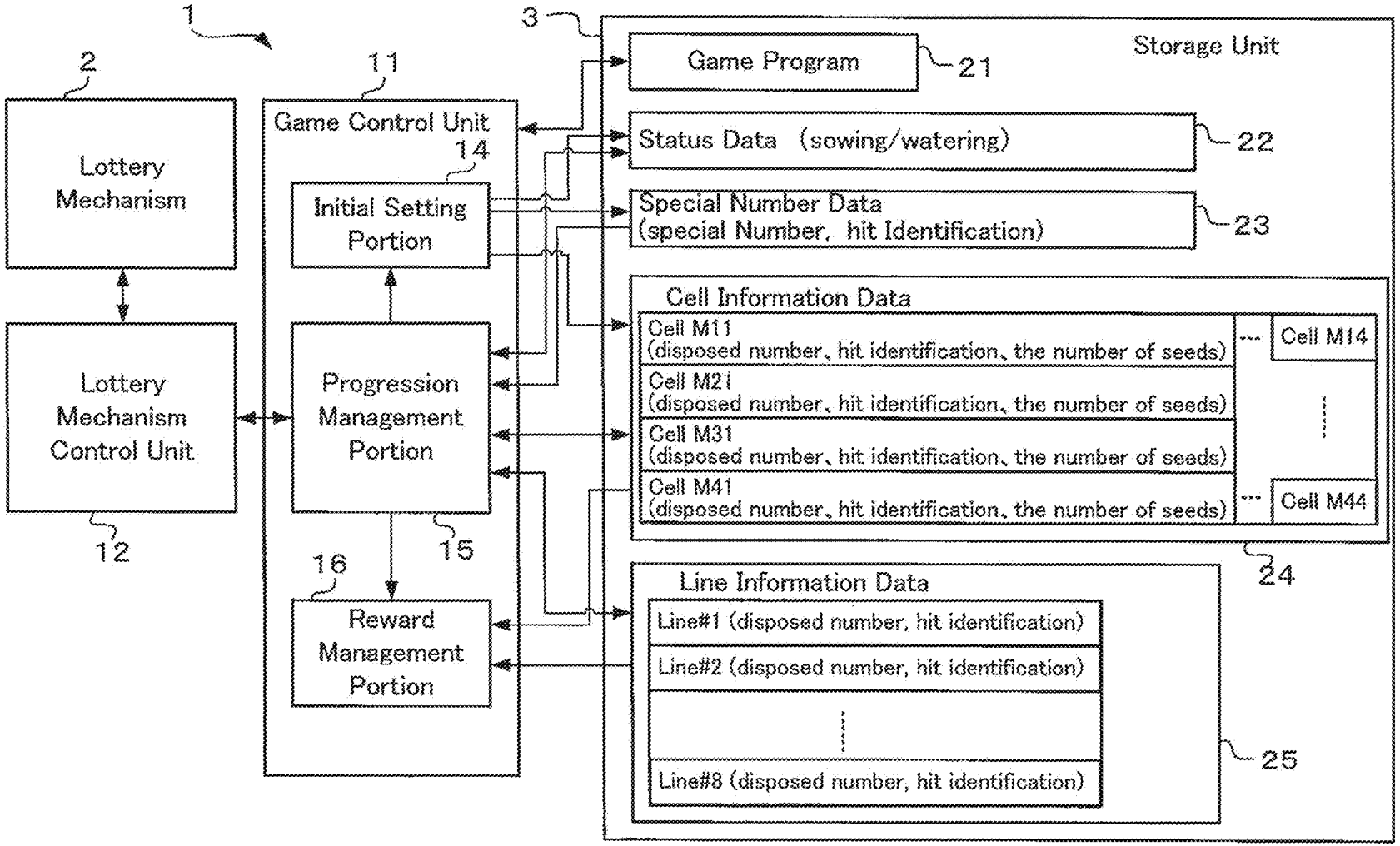
FIG. 5 is a functional block diagram showing a structure of a control system of the game machine.

FIG. 5 is a functional block diagram showing the structure of a control system of the game machine 1. A game control unit 11 that controls the cultivation game, a lottery mechanism control unit 12 that controls the operation of the lottery mechanism 2, and a storage unit 13 are provided to the game machine 1. The game control unit 11 and the lottery mechanism control unit 12 are logical devices that are realized by a combination of hardware (including a CPU and a memory, which is a device internal thereto) and software of the game machine 1. The storage unit 13 is a device that includes a non-volatile storage medium such as a magnetic storage medium, an optical storage medium, an EEPROM, or the like. A game program 21 for executing the game upon the game machine 1, status data 22, special number data 23, cell information data 24, and line information data 25 are stored in the storage unit 13. In addition, the storage section 13 stores play data for recording data needed for the user to continue the game such as game results and so on, and data of various kinds needed for executing the game.

The status data 22 is data that records the stage at which the cultivation game is currently operating. In concrete terms, this status data records which of the sowing stage and the watering stage is currently going on in the cultivation game. Moreover, it would also be acceptable to record how many numbers have been selected by the lottery mechanism 2, that is, the number of times number selection has been performed. In the special number data 23, the numbers that are displayed in the lucky number display section 103 during the sowing stage and the watering stage, and the numbers that have been set as the lucky numbers within the flower bed 101 are recorded as special numbers. In the cell information data 24, with respect to each of the cells M11 through M44, the number that has been associated with and disposed to the cell M, identification as to whether the associated number has been hit or not, and the number of seeds in the cell M are recorded in association with the cell M. And in the line information data 25, with respect to each of the lines, the number that has been associated with and disposed to the line, and identification as to whether the associated number has been hit or not, are recorded in association with the line.

The game control unit 11 reads and executes the game program 21 stored in the storage unit 13. Thereby an initial setting portion 14 which is configured to set the status data 22, the special number data 23, and the cell information data 24 before the cultivation game starts, a progression management portion 15 which is configured to manage the progression of the cultivation game, and a reward management portion 16 which is configured to manage a reward to be given to the user after the cultivation game ends according to the game result, are provided in the game control unit 11 as logical devices. In addition, the lottery mechanism control unit 12 controls the operation of the lottery mechanism 2, and notifies the lottery results to the progression management portion 15.

Figure 6:
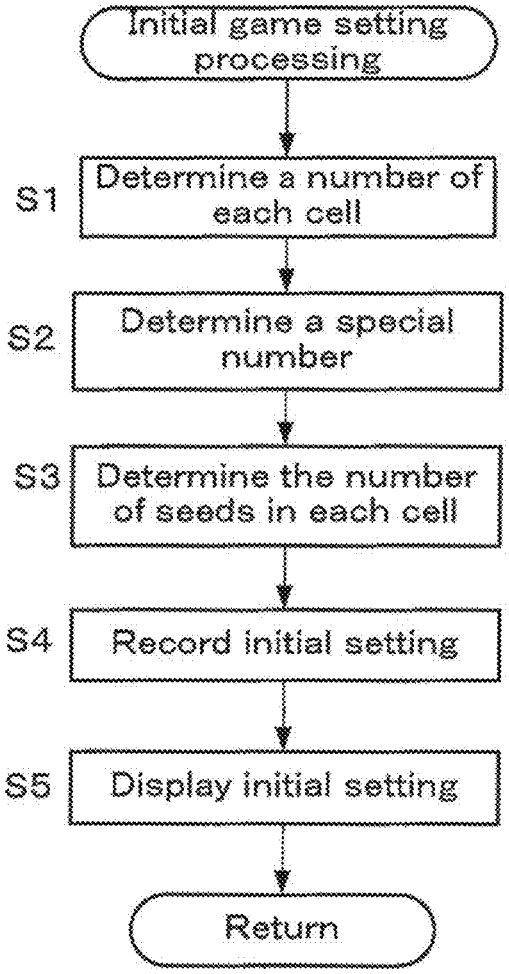
FIG. 6 is a flow chart for explanation of initial game setting processing executed by a game control unit of the game machine.

FIG. 6 is a flow chart for explanation of initial game setting processing executed by the game control unit 11 of the game machine 1. This initial game setting processing sets the status data 22, the special number data 23, and the cell information data 24 for the start of the cultivation game. The game control unit 11 determines numbers that correspond to each of the cells M11 through M44 (in step S1). As described above, the numbers that are allocated to the cells M are determined at random by using random numbers, but it would also be acceptable to allow the user to select the cells M that are associated with specific numbers. As an example of how this selection may be implemented, it would be acceptable to present a specific number to the user, and to allow him/her to select the cell M to which that number is to be allocated. Alternatively, it would also be acceptable to arrange to display the number that is to be associated with each cell M upon the flower bed 101, and to enable the user to re-arrange association of the number to the cell M until he/she decides to confirm it.

The game control unit 11 then determines the special number (in step S2). By referring to the numbers that were determined in the step S1, one number that should be displayed upon the lucky number display section 103 is determined from among a group of numbers that have not been associated with the cells M, and some numbers which should be set as the lucky numbers in the flower bed 101 are determined from among a group of numbers that have been associated with the cells M. It should be understood that it would also be acceptable for the numbers that are set as the lucky numbers in the flower bed 101 to be determined in dependence upon the positions of the cells M. For example, it would be acceptable to arrange for the numbers associated with the cells M11, M22, M33, and M44 which are lined up along the diagonal to be set as the lucky numbers. The number of lucky numbers in the flower bed 101 is not limited to being four; it may be set as appropriate. It would also be acceptable to arrange to increase the number of lucky numbers in exchange for expenditure of his/her credits.

The game control unit 11 then determines the number of seeds for each of the cells M11 through M44 (in step S3). The number of seeds in each of the cells M is determined as being between zero and four. It would be acceptable to arrange to permit the user to plant seeds in desired cells M in exchange for expenditure of his/her credits, or alternatively it would also be acceptable to arrange for predetermined numbers of seeds to be planted in appropriate cells M in advance. The game control unit 11 records the initial settings that have been determined in the steps S1 through S3 in the special number data 23 and in the cell information data 24 (in step S4). Along therewith, the game control unit 11 initializes the status data 22, and sets the status data 22 to the sowing stage. Then the game control unit 11 displays the numbers and the sprouts 102*a* upon the flower bed 101 on the basis of the status data 22, the special number data 23 and the cell information data 24 (in step S5), and then terminates this episode of processing. According to the processing described above, the initial settings that are required for game progression before the cultivation game starts are determined (in the steps S1 through S3), are recorded in the status data 22, in the special number data 23, and in the cell information data 24 (in the step S4), and are displayed upon the game screen 100 (in step S5).

Figure 7:
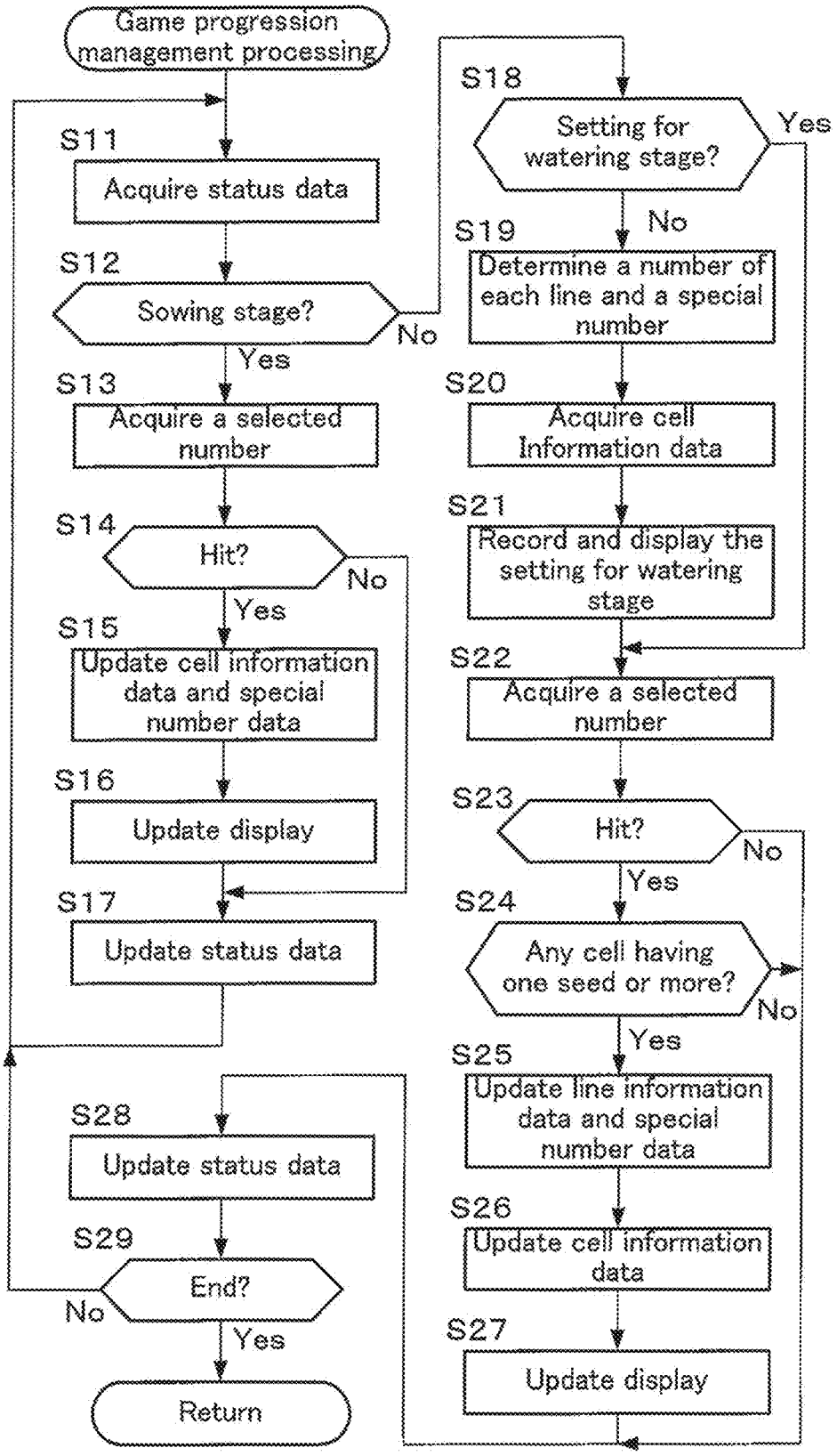
FIG. 7 is a flow chart for explanation of game progression management processing executed by the game control unit of the game machine.

FIG. 7 is a flow chart for explanation of game progression management processing executed by the game control unit 11 of the game machine 1. This game progression management processing is processing for controlling the progression of the cultivation game, and is executed each time a number has been selected by the lottery mechanism 2. The game control unit acquires the status data 22 (in step S11), and determines whether or not the current stage is the sowing stage (in step S12). In a case that the current stage is the sowing stage, then the game control unit 11 acquires the number selected by the lottery mechanism 2 (in step S13), and determines whether or not there is a cell M which has been hit (in step S14). The number that has been selected and the cell information data 24 and the special number data 23 are compared together, and whether or not there is a hit. In a case that there is a cell M which has been hit, then the number of seeds in this cell M is increased by one. And, in a case that the number in the cell M that has been hit is set as the lucky number, then the numbers of seeds in the cells M that are influenced (for example, the cells M in a vertical line) are also increased by one. In a case that the number that is displayed in the lucky number display section 103 has been hit, then the numbers of seeds in all of the cells M are increased by one.

The game control unit 11 then updates the cell information data 24 and the special number data 23 (in step S15). According to the number that has been selected, the hit identification of the cells M that has been hit and the number of seeds in the cells M for which the seeds have increased are changed. The game control unit 11 then updates the display of the game screen 100 (in step S16), and returns to step S11 to repeat this processing. Sowing seeds in the cells M of the flower bed 101, changing the states of the cells M, providing effects when numbers corresponding to the cells M are hit, providing effects when the number displayed in the lucky number display section 103 is hit, and so on are included in updating of the display on the game screen 100. Furthermore, in a case that there is no cell M which has been hit in the step S14, then the game control unit 11 skips the processing of the steps S15 and S16, and the flow of control proceeds to step S17. The game control unit 11 then updates the status data 22 (in step S17). In a case that the sowing stage has ended, the system changes over the status data to the watering stage. On the other hand, in a case that the sowing stage is to be continued, then the number of times number selection has been performed in the sowing stage is recorded.

In a case that the current stage in the step S12 is not the sowing stage, in other words in a case that the current stage is the watering stage, then the game control unit 11 determines whether or not the initial settings for the watering stage have not yet been established (in step S18). In a case that directly after change from the sowing stage to the watering stage the initial settings for the watering stage have not yet been established, then the game control unit 11 determines the numbers that should be associated with each of the lines #1 through #8 and the special number (in step S19). The numbers associated with each of the lines #1 through #8 are determined at random from among numbers that have not yet been selected by the lottery mechanism 2. Moreover, the number that is displayed in the lucky number display section 103 as the special number is determined from among a group of numbers that are not associated with any lines by reference to the numbers determined in the step S19. The game control unit 11 then acquires the cell information data 24 (in step S20). And the game control unit 11 records the initial settings for the watering stage that were determined in the steps S19 and S20 in the line information data 25 and the special number data 23, and, on the basis of this data 23 and 25, along with displaying the numbers in the number display sections 108 and in the lucky number display section 103 respectively, also displays the sprouts 102*a* in the cells M (in step S21). Due to this, the numbers of seeds that were acquired in the sowing stage are kept the same, and the initial settings for the watering stage are displayed. It should be understood that, in a case that the initial settings for the watering stage have already been made in the step S18, then the game control unit 11 skips the processing of the steps S19 through S21.

Then the game control unit 11 acquires the number selected by the lottery mechanism 2 (in step S22), and determines whether or not there are cells M that have been hit (in step S23). Here, by referring to the number that has been selected and to the line information data 25, the game control unit 11 determines whether or not there is a line that has been hit. Further, by referring to the special number data 23, the game control unit 11 determines whether or not the number displayed in the lucky number display section 103 has been hit. in a case that there is a line that has been hit or in a case that the lucky number has been hit, then the game control unit 11 determines whether or not there is any cell M having one seed or more among the cells M belonging to the line that has been hit, or among all of the cells M (in step S24).

In a case that there is, among the cells Ma as the subjects, a cell M having one or more seeds, then the game control unit 11 updates the line information data 25 and the special number data 23 (in step S25). The hit identification of the line that has been hit is changed in response to the number that has been selected. Moreover, the game control unit 11 updates the cell information data 24 (in step S26). Here, in a case that on the basis of the line information data 25 and the special number data 23, at least one of two horizontal and vertical lines to which a cell M belongs, or the lucky number has already been hit in the watering stage, then one is added to the number of seeds in each of the corresponding cells M. However, in a case that either one of the two horizontal and vertical lines to which a cell M belongs or the lucky number has been hit for the first time in the watering stage, or in a case that the number of seeds in the cell has reached four, then addition to the number of seeds is not performed.

The game control unit 11 then updates the display of the game screen 100 (in step S27). And, for each of the cells M, the game control unit 11 determines whether or not the number of seeds in the cell M is one or more, and, in a case that there is one seed or more in this cell M, then a determination is made as to whether any of the numbers, among the two horizontal and vertical lines to which this cell M belongs and the lucky number displayed in the lucky number display section 103, has been hit or not. In a case that any of these numbers has been hit, then the same number of flowers 102*b* are displayed as the number of seeds that cell M has. It should be understood that the processing in the display processing for the game screen 100 related to identification of the flowers 102*b* may be the same as the processing of steps S31 through S36 in the reward giving processing of FIG. 8, which will be described hereinafter. It would also be acceptable to arrange for a change from a sprout 102*a* to a flower 102*b* to be shown, in a case one of the two horizontal and vertical lines to which the cell M belongs or the lucky number has been hit for the first time. In a case that a cell M has one or more seeds, but neither of the two horizontal and vertical lines to which the cell M belongs nor the lucky number displayed in the lucky number display section 103 has been hit, then the same number of sprouts 102*a* as the number of seeds are displayed in the cell M; while, in a case of a cell M for which the number of seeds is zero, nothing is displayed in that cell M. As well as the above, sprinkling of water upon the cells M of the flower bed 101 may be shown, and so on. Moreover, in a case that no line is hit in the step S23, or in a case that there is no cell M for which the number of seeds is one or more in the step S24, then the game control unit 11 skips the processing of the steps S25 through S27, and the flow of control proceeds to step S28.

The game control unit 11 then updates the status data 22 (in step S28). The number of times number selection has been performed in the watering stage is recorded. And the game control unit 11 refers to the status data 22 to determine whether or not the watering stage ends (in step S29). This is determined by referring to the number of times number selection has been performed in the watering stage, which is recorded in the status data 22. When the watering stage has ended, then the game control section 11 terminates the current episode of processing. But when the watering stage is to be continued, then the flow of control returns to the step S11 and the processing is repeated.

In the processing described above, the current stage is determined (in the step S12), and there is a difference in the progression control between the sowing stage (i.e. in the steps S13 through S17) and the watering stage (i.e. in the steps S18 through S28). Since there is a difference in the correlation between the cells M and the numbers between the two stages, accordingly it is possible to change the number of seeds in each cell M in a flexible manner. Moreover, the number of seeds in each of the cells M acquired in the sowing stage is also maintained during the watering stage, and the game in the watering stage progresses with the cells M that have seeds as subjects. It is possible to change the values in the cells M in many different ways at each stage, while still keeping relativeness between the stages.

Figure 8:
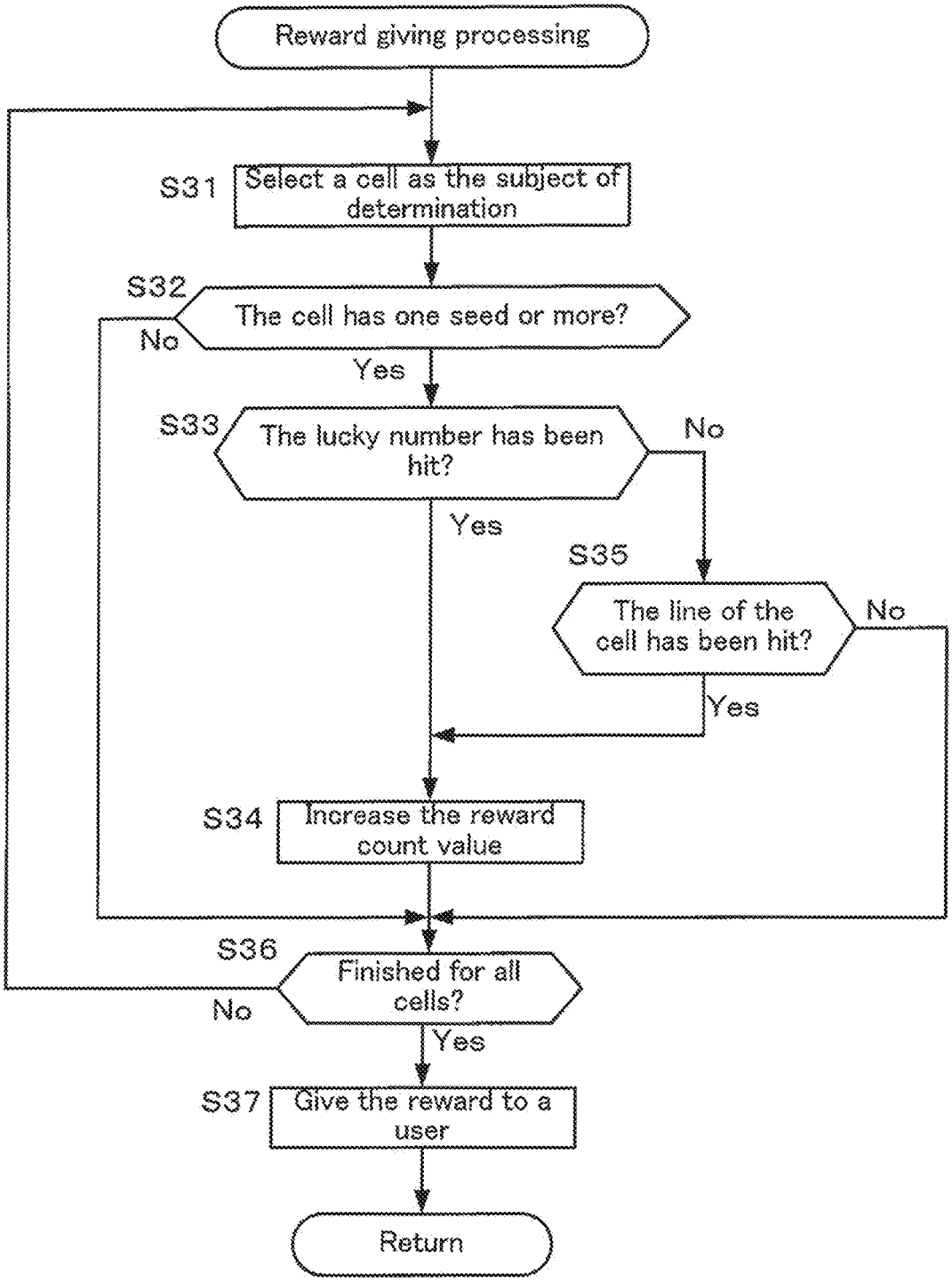
FIG. 8 is a flow chart for explanation of reward giving processing executed by the game control unit of the game machine.

FIG. 8 is a flow chart for explanation of reward giving processing executed by the game control unit 11 of the game machine 1. In this reward giving processing, a reward for the user is determined after the cultivation game has ended, and the reward determined is given to the user. The game control unit 11 selects a cell M that is to be the subject of determination (in step S31), and refers to the cell information data 24 in order to determine whether or not the number of seeds in that cell is one or more (in step S32). In a case that this number of seeds is one or more, the game control unit 11 determines whether or not the number displayed upon the lucky number display section 103 has been selected (in step S33). In a case that the number upon the lucky number display section 103 has been selected, then the game control unit 11 adds the number of seeds in this cell M to the reward count value (in step S34). On the other hand, in a case that the number upon the lucky number display section 103 has not been selected, then the game control unit 11 determines whether or not a line to which this cell M belongs has been hit (in step S35). Each individual cell M belongs to a total of two lines, a vertical line and a horizontal line. Either one of these lines may be hit. In a case that a line to which the cell M that is the subject belongs has been hit, then the game control unit 11 advances the flow of control to step S34. In a case that it is determined that the number of seeds is zero in the step S32, or in a case that it is determined that neither of the lines to which the cell M that is the subject has been hit in the step S35, then the game control unit 11 advances the flow of control to step S36.

Then, the game control unit 11 determines whether or not the processing of the steps S32 to S35 has been executed for all of the cells M (in step S36), and in a case that the processing has not yet been executed for all of the cells M, then the flow of control returns to the step S31 and the processing described above is repeated. In a case that the processing has been completed for all of the cells M, then the game control unit 11 gives a reward to the user according to the reward count value, in other words according to the number of flowers 102*b* in all of the cells M (in step S37), and returns the reward count value to zero and then terminates this episode of processing. Moreover, in a case that an apple 107*a* has been given to a cell M in which a flower 102*b* is blooming, then this apple 107*a* is also given to the user at the same time.

According to the processing described above, the number of flowers 102*b* in all of the cells M are added together (in the steps S31 through S36), and a reward is given to the user according to the number of flowers 102*b* (in the step S37). Since the sprouts 102*a* existing at the end of the watering stage do not cause a reward, it is possible to adjust the reward by adjusting the changes to flowers 102*b*.

The present invention is not to be considered as being limited to the embodiment described above; it could be implemented in various different ways. For example, the present invention is not limited to the example explained in the above embodiment, in which, as the selection of some numbers from a plurality of numbers, the lottery mechanism 2 selects a total of eight numbers in three lottery performances. Thus, for example, it would also be acceptable to arrange for all of the numbers that are to be selected in the cultivation game to be selected in a single lottery; or it would also be acceptable for a single number to be selected in each lottery. The method of selection may be changed as appropriate, provided that some numbers, the number of which is required in the cultivation game, are selected. Moreover, the element selection device is not limited to being a physical or electronic lottery mechanism. For example, it would be acceptable for numbers to be selected by playing another game that is provided within the game machine 1, or by playing another game that is provided by another game machine that is capable of mutual communication with this game machine 1 via a network. Alternatively, it would also be possible for these numbers to be numbers that are inputted from the exterior, such as numbers that are announced at an event or numbers that are designated by other users or the like. Numbers of this type are inputted via an input device, and are acquired by the game control unit 11 as selected numbers from the input device. Moreover, the subjects of selection are not limited to being numbers. These subjects of selection are not to be considered as being particularly limited, provided that they can be mutually distinguished from one another by color, symbol, pattern, or the like. Furthermore, the way in which the selective elements are selected is not limited to being via the use of a lottery device; the selective elements may be determined in any manner, provided that at least a single selective element is selected from a plurality of selective elements for lottery.

In the embodiment described above, the cells M11 through M44 of the flower bed 101 were explained as being a plurality of game elements, and the values thereof were explained as being the numbers of seeds sown in each of the cells M and as changes of the states thereof (the sprouts 102*a* and the flowers 102*b*), but this should not be considered as being limitative. For example, it would be possible to make changes to values (i.e. changes to colors, changes to effects, changes to shapes, and so on) like the changes in the cultivation game described above, and even to the forms of characters (game characters, animals, fish, and so on), or of items (weapons, jewelry, food, and so on), or of terrain (sea, mountains, countries, houses, castles, and so on). The display device 3 may be controlled so as to display images corresponding to these changes of values upon the game screen. Moreover, instead of the number of seeds, it would also be acceptable to make changes to the colors of the sprouts 102*a* or the colors of the flowers 102*b* according to the values of the numbers of seeds. The way in which the values of the game elements are expressed may be changed as appropriate. Moreover while, in the embodiment described above, the explanation postulated the plurality of cells M11 through M44 which were arranged in four rows and four columns along two axes, vertical and horizontal, this should not be considered as being limitative. For example, it would be acceptable to arrange for cells to be lined up along three dimensions in three dimensional space, or to arrange to lay down hexagonal cells with no gaps between them, with adjacent cells crossing over one another in three directions. Alternatively, a plurality of cells M may be arranged at random within a predetermined region. The arrangement of the cells M may be changed as appropriate, according to the contents of the game.

Figure 9:
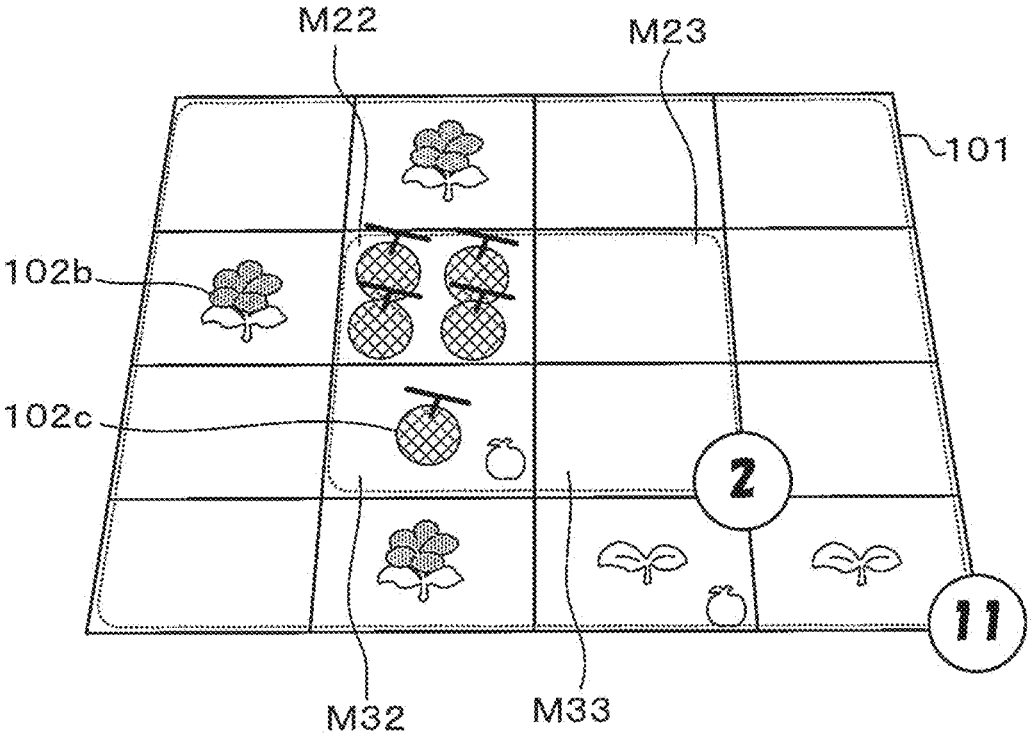
FIG. 9 is a diagram for explanation of another cultivation game, in which a third stage is provided.

In the embodiment described above, a case has been explained in which a "sowing stage" and a "watering stage" were provided as a plurality of stages, so that a case in which there are two stages has been described, but this is not to be considered as being limitative. For example, it would also be possible to provide a third stage. FIG. 9 is a figure for explanation of a cultivation game in which a third stage is provided. As the third stage, a "harvesting stage" in which a change is made from the flowers 102*b* to fruits 103*c* is provided next after the watering stage, and a single number is selected by the lottery mechanism 2. Numbers that are determined at random from among the remaining numbers excluding the numbers that have already been selected are associated with a group consisting of the cells M22, M23, M32, and M33 and a group consisting of all the cells M11 through M44 respectively. In FIG. 9, the number "2" has been selected by the lottery mechanism 2, and the flowers 102*b* that were blooming in the cells M22, M23, M32, and M33 that are associated with this number "2" has changed into fruits 103*c*.

In this example in which the third stage is provided, in the reward giving processing, it would be acceptable, while calculating the reward by dealing with the fruits 102*c* in a similar manner to the flowers 102*b*, also to arrange to add a bonus according to the number of fruits 102*c*; or it would be possible to give a reward for the fruits 102*c*. Any appropriate calculation method may be employed. It would also be acceptable to provide four or more stages by changing the correlation between the cells M and numbers. In this format in which a plurality of stages are provided, it would be acceptable for the correlation between the selection by the lottery mechanism 2 and the control of the values of the game elements to be set so as to be mutually different between at least two of the stages. For example, in a game in which the three stages are provided, the correlation between the numbers selected by the lottery mechanism and the cell M may be the same in the first stage and in the second stage, but this is still to be considered as being included within the technical scope of the present invention, provided that the correlation in the first and second stages and the correlation in the third stage are mutually different. In the distinction between stages, the stages may be judged as being different from one another provided that there are any changes in the game, such as a case that the area or stage or the like where the game is deployed is simply different, a case that a character that is the subject of the game is different, or the like. In this way, when a plurality of stages are provided, it will be sufficient as long as there is a difference between the correlations of at least two of the stages.

Furthermore, in the embodiment described above, a case was explained in which the subject of the game in the second stage was limited to the cells M in which seeds were sown in the first stage, but this should not be considered as being limitative. For example, it would also be acceptable for the cells M in which seeds were sown in the first stage to be set as the subjects of the game in the third stage. In this case, it would be acceptable for the progression of the game in the second stage to take all of the cells M as subject. Moreover, with regard to the correlation in each of the stages, they are not limited to the embodiment described above. For example, it would be acceptable for two neighboring cells M to be made to associate with a single number as a group, or, as in the example with the third stage described above, for a plurality of groups to each of which a different number of cells M belongs to be provided, with one or more numbers being associated with each group. Any appropriate correlation may be established. Alternatively, it would also be acceptable only to change the associated numbers between the first stage and the second stage. For example, in the first stage, a single number may be associated with each cell M, while, in the second stage, a new different number may be associated with each cell M.

In the embodiment described above, the number of seeds in each of the cells M is maintained when the change from the sowing stage to the watering stage is performed, and the number of sprouts 102*a* in each of the cells M does not change. However, the present invention is not to be considered as being limited to an example in which the values of the game elements are not changed between before and after the change of stage. For example it would also be acceptable, on the basis of the number of seeds at the moment when the sowing stage ends, to make each sprout to change into a flower 102*b* from the beginning in the watering stage and progress the game. Or, in a case that more than one seed (sprout) is present in a single cell M, it would also be acceptable to make a single one of the sprouts 102*a* to change into a flower 102*b*. Other appropriate variations may be implemented.

In the embodiment described above, a case has been explained in which the values of the game elements are raised by increasing the number of seeds in each of the cells M and causing changes from the sprouts 102*a* into the flowers 102*b*. However, this should not be considered as being limitative of the present invention. It would also be acceptable to arrange to lower the values of the game elements according to selection of numbers by the lottery mechanism 2. For example it would be acceptable, in the sowing stage described above, in a case a number that has been selected by the lottery mechanism 2 is not associated with any one of the cells M, to arrange to kill off one of the sprouts 102*a* that is planted in a cell M of the flower bed 101. Alternatively, it would also be acceptable to arrange to set a number which kills off the sprouts 102*a* in all of the cells M. Theses settings may be appropriately adjusted according to the degree of difficulty desired for the game.

In the embodiment described above, the numbers that are associated with each of the lines and the number displayed in the lucky number display section 103 are determined before the watering stage is started, and are recorded in the line information data 25 and in the special number data 23 (in the steps S19 through S21). However, it would also be acceptable for these numbers to be determined in advance. In a similar manner, in the sowing stage, it would also be acceptable to execute in advance: the determination of the number associated with each of the cells M; the determination of the special number; and the determination of the number of seeds for each of the cells M.

In the embodiment described above, credits according to the value of each cell M were given to the user as a reward. However, this is not intended to be limitative of the present invention. For example, items that can be used in a game other than the cultivation game, or game benefits or the like, may be employed. In a case that weapon items are given as rewards, it will be sufficient to change the grades of the weapons according to the value of each cell M. In a similar manner, it may also be appropriate to change game benefits such as character reinforcement and opening of specific stages. In this case, the cultivation game may be supplied as a game that can be played during a different game. It would also be acceptable to arrange for images of items or the like to be provided to be displayed upon each of the cells M of the game screen.

In the embodiment described above, all of the cells M11 through M44, which are the plurality of game elements displayed upon the game screen 100, are set as the objects of control by the value control device which executes control on the basis of the selection by the element selection device. However, it would also be acceptable to arrange for the objects of control by the value control device to be only some of the game elements, among the plurality of game elements that are displayed upon the game screen 100. For example, it would be acceptable to make the cell M22, the cell M23, the cell M31, and the cell M32 be the objects of control by the value control device, and to change the values in the cells M11 through M14, the cell M21, the cell M24, the cell M33, the cell M34, and the cells M41 through M44 with the other device. For example, as the other device, it would be acceptable to perform changes of those values without depending upon lottery by the element selection device, on the basis of the results of a game such as a quiz game or an action game or the like; or it would also be possible to change the values based upon the frequency of game-play by the user. Alternatively, it may also be acceptable to depend upon the results of lottery by the element selection device. For example, as the other device, the following device could be employed: a single number is associated with each of the cells M like a general bingo game; and it is determined whether or not each of the cells M is activated depending on the number selected; and the value is changed as appropriate. The number of game elements that are to be the objects of control may be one or more, and the value control device may be allowed to control the value of at least a single game element on the basis of selection by the element selection device.

Various aspects of the present invention derived from each of the above described embodiments and variant embodiments will now be described below.

One embodiment as one aspect of the present invention is a game system comprising an element selection device which is configured to select some selective elements from among the plurality of selective elements, and a computer programmed to function as a value control device which is configured to control, in a plurality of stages based on selection by the element selection device, a value for each game element which is displayed in a game image, wherein: the value control device is configured to set correlations between selection by the element selection device and control of the value of each game element so as to be mutually different between at least two of the plurality of stages; and, while controlling the value of each game element in each of the plurality of stages based on the selection by the element selection device and the correlation for each of the plurality of stages, when a change to a different stage is made, set the value of each game element after the change based on the value of the game element before the change.

One embodiment as another aspect of the present invention is a method for controlling a game system comprising a computer, the computer controlling a value for each game element displayed in a game image, in a plurality of stages based on selection of some selective elements from among a plurality of selective elements by a predetermined element selection device, comprising the steps of: setting correlations between selection by the element selection device and control of the value of each game element so as to be mutually different between at least two of the plurality of stages; controlling the value of each game element in each of the plurality of stages based on the selection by the element selection device and the correlation for each of the plurality of stages; and when a change to a different stage is made, setting the value of each game element after the change based on the value of the game element before the change.

One embodiment as a further aspect of the present invention is a non-transitory computer readable storage medium storing a computer program for a game system comprising a computer, the computer controlling a value for each game element displayed in a game image, in a plurality of stags based on selection of some selective elements from among a plurality of selective elements by a predetermined element selection device, the computer program making the computer execute the steps of: controlling the value of each game element in each of the plurality of stages based on the selection by the element selection device and the correlation for each of the plurality of stages; and when a change to a different stage is made, setting the value of each game element after the change based on the value of the game element before the change.

According to the present invention, the value of each game element is controlled for each step. And, when a change of stage is performed, the value of the game element after the change is set on the basis of the value of the game element before the change.

By using the computer readable storage medium of the present invention, if the computer program stored therein is installed to a computer and executed, thereby, it is possible to realize the game system of the present invention through the computer. The non-transitory computer readable storage medium may be a CD-ROM or the like.

In one embodiment of the present invention, the value control device may be configured to set as subject a game element, the value of the game element having reached a predetermined state in a predetermined stage, and control the value of the game element in a stage different from the predetermined stage.

In one embodiment of the present invention, a plurality of the game elements may be provided, and the value control device may be configured to associate the plurality of selective elements selectively with each of the plurality of game elements for each of the plurality of stages. In this embodiment, the value control device may be configured to associate the plurality of selective elements selectively with each of the plurality of game elements so that a number of game elements associated to a single selective element is different for each stage.

Further, in this embodiment, the plurality of stages may include a first stage and a second stage which is changed from the first stage; and the value control device may be configured to, in the first stage, associate one of the plurality of selective elements selectively with each of the plurality of game elements so that each selective element associated is different from each other, and in the second stage, divide the plurality of game elements into a plurality of groups and associate one of the plurality of selective elements selectively with each of the plurality of groups so that each selective element associated is different from each other. In this embodiment, the value control device may be configured to comprise: a first value control device configured to control the value of each of the plurality of game element so that in a case that the selective element associated with the game element is selected by the element selection device, the value of the game element is changed; and a second value control device configured to control the value of each of the plurality of game elements so that, in a case that the selective element associated with any one of the plurality of groups is selected by the element selection device, the value of the game element belonging to the group and also having reached a predetermined value is changed. In this embodiment, the plurality of game elements may be displayed in the game image so as to be arranged in a plurality of directions; and the value control device may be configured to set each of the plurality of groups for each group of the game elements arranged in a same direction.

In the above mentioned embodiment, the value control device may be configured to associate a specific selective element with a predetermined group of game elements within the plurality of game elements; and the first value control device may be configured to control the value of each game element so that, in a case that the specific selective element is selected by the element selection device, the value of the game element belonging to the predetermined group of game elements is changed.

In one embodiment of the present invention, the computer may be programmed so as to further function as a reward giving device which is configured to give a reward to a user according to the values of the game elements at a moment when the selection of selective elements by the element selection device reaches a predetermined state.

What is claimed is:

1. A game system comprising an element selection device which is configured to select some selective elements from among the plurality of selective elements, and a computer programmed to function as a value control device which is configured to control, in a plurality of stages based on selection by the element selection device, a value for each game element which is displayed in a game image, wherein:

the value control device is configured to set correlations between selection by the element selection device and control of the value of each game element so as to be mutually different between at least two of the plurality of stages; and, while controlling the value of each game element in each of the plurality of stages based on the selection by the element selection device and the correlation for each of the plurality of stages, when a change to a different stage is made, set the value of each game element after the change based on the value of the game element before the change.

2. The game system according to claim 1, wherein the value control device is configured to set as subject a game element, the value of the game element having reached a predetermined state in a predetermined stage, and control the value of the game element in a stage different from the predetermined stage.

3. The game system according to claim 1, wherein a plurality of the game elements are provided, and the value control device is configured to associate the plurality of selective elements selectively with each of the plurality of game elements for each of the plurality of stages.

4. The game system according to claim 3, wherein the value control device is configured to associate the plurality of selective elements selectively with each of the plurality of game elements so that a number of game elements associated to a single selective element is different for each stage.

5. The game system according to claim 3, wherein:

the plurality of stages includes a first stage and a second stage which is changed from the first stage; and the value control device is configured to, in the first stage, associate one of the plurality of selective elements selectively with each of the plurality of game elements so that each selective element associated is different from each other, and in the second stage, divide the plurality of game elements into a plurality of groups and associate one of the plurality of selective elements selectively with each of the plurality of groups so that each selective element associated is different from each other.

6. The game system according to claim 5, wherein the value control device is configured to comprise:

a first value control device configured to control the value of each of the plurality of game element so that in a case that the selective element associated with the game element is selected by the element selection device, the value of the game element is changed; and a second value control device configured to control the value of each of the plurality of game elements so that, in a case that the selective element associated with any one of the plurality of groups is selected by the element selection device, the value of the game element belonging to the group and also having reached a predetermined value is changed.

7. The game system according to claim 5, wherein:

the plurality of game elements are displayed in the game image so as to be arranged in a plurality of directions; and the value control device is configured to set each of the plurality of groups for each group of the game elements arranged in a same direction.

8. The game system according to claim 6, wherein:

the value control device is configured to associate a specific selective element with a predetermined group of game elements within the plurality of game elements; and the first value control device is configured to control the value of each game element so that, in a case that the specific selective element is selected by the element selection device, the value of the game element belonging to the predetermined group of game elements is changed.

9. The game system according to claim 1, wherein the computer is programmed so as to further function as a reward giving device which is configured to give a reward to a user according to the values of the game elements at a moment when the selection of selective elements by the element selection device reaches a predetermined state.

10. A method for controlling a game system comprising a computer, the computer controlling a value for each game element displayed in a game image, in a plurality of stages based on selection of some selective elements from among a plurality of selective elements by a predetermined element selection device, comprising the steps of:

setting correlations between selection by the element selection device and control of the value of each game element so as to be mutually different between at least two of the plurality of stages;

controlling the value of each game element in each of the plurality of stages based on the selection by the element selection device and the correlation for each of the plurality of stages; and when a change to a different stage is made, setting the value of each game element after the change based on the value of the game element before the change.

11. A non-transitory computer readable storage medium storing a computer program for a game system comprising a computer, the computer controlling a value for each game element displayed in a game image, in a plurality of stags based on selection of some selective elements from among a plurality of selective elements by a predetermined element selection device, the computer program making the computer execute the steps of:

controlling the value of each game element in each of the plurality of stages based on the selection by the element selection device and the correlation for each of the plurality of stages; and when a change to a different stage is made, setting the value of each game element after the change based on the value of the game element before the change.

* * * * *